US010654074B2

(12) United States Patent
Fanaian et al.

(10) Patent No.: US 10,654,074 B2
(45) Date of Patent: May 19, 2020

(54) ELECTRONIC AND DIGITAL ASSEMBLY SYSTEM FOR DRY CLEANING

(71) Applicants: Evaz Fanaian, Alpharetta, GA (US); Nabil Fanaian, Alpharetta, GA (US)

(72) Inventors: Evaz Fanaian, Alpharetta, GA (US); Nabil Fanaian, Alpharetta, GA (US)

( * ) Notice: Subject to any disclaimer, the term of this patent is extended or adjusted under 35 U.S.C. 154(b) by 0 days.

(21) Appl. No.: 16/243,752

(22) Filed: Jan. 9, 2019

(65) Prior Publication Data

US 2019/0184429 A1 Jun. 20, 2019

Related U.S. Application Data

(63) Continuation of application No. 15/789,780, filed on Oct. 20, 2017, now Pat. No. 10,207,293.

(60) Provisional application No. 62/411,418, filed on Oct. 21, 2016.

(51) Int. Cl.
*B07C 3/00* (2006.01)
*B07C 5/34* (2006.01)

(52) U.S. Cl.
CPC ..... *B07C 3/005* (2013.01); *B07C 5/3412* (2013.01)

(58) Field of Classification Search
CPC ..... B07C 3/005; B07C 5/3412
USPC ..... 700/214, 215, 221, 224, 225
See application file for complete search history.

(56) References Cited

U.S. PATENT DOCUMENTS 4,160,333 A * 7/1979 Indelicato ..... A47G 25/1428 223/85
4,605,847 A * 8/1986 Schittko ..... G06K 7/10861 235/454
4,875,416 A * 10/1989 Duce ..... B65G 33/02 104/167
5,058,750 A * 10/1991 Gr se ..... B07C 5/3412 198/465.4
5,125,513 A * 6/1992 Branch ..... B07C 5/3412 198/360
5,572,775 A * 11/1996 Mailloux ..... A47G 25/1407 211/123
5,932,867 A * 8/1999 Speckhart ..... G07G 1/0036 235/385
6,578,671 B2 * 6/2003 Shen ..... G06Q 10/0875 186/35
8,162,213 B2 * 4/2012 Larson ..... G06Q 10/087 235/385
8,985,440 B2 * 3/2015 Pacque ..... G07F 17/12 235/380
9,043,234 B2 * 5/2015 Delaney ..... B65B 5/00 705/28
2007/0261997 A1 * 11/2007 Cassady ..... B07C 5/3412 209/3.3
2015/0272364 A1 * 10/2015 Larsen ..... G09F 9/313 223/96

* cited by examiner

*Primary Examiner* — Leslie A Nicholson, III
(74) *Attorney, Agent, or Firm* — Laurence P. Colton; Carlos Julio Salas Martinez; Smith Tempel Blaha LLC

(57) ABSTRACT

An LED Assisted Rapid Assembly system is disclosed wherein a plurality of rack locations are provided with an addressable LED light puck at each location, such that the puck may be illuminated to indicate to a worker the rack location for a specific garment by correlating the garment, the invoice/ticket and the location electronically and controlling the LED.

12 Claims, 9 Drawing Sheets

ENLITECLOUD - HTTP:// [illegible] /PICK  Settings | Reload Start Page  – ⧉ x

Enlite Store | NABIL STATION - PRINTER | Minor Employee  Pick ✖

Pickup Slip

| Invoice Detail | | | | Ready | Picked | All | None | |
|---|---|---|---|---|---|---|---|---|
| Invoice | Rack | PCs | Left | Drop | Ready | Balance | Discount | Pick | Pay |
| v 306-1 | | 4 | | 3/16/2017 | | **$16.70** | $0.00 | ☑ | ☑ |
| v 304-1 | | 1 | | 3/16/2017 | | **$3.25** | $0.00 | ☐ | ☑ |
| v 303-1 | | 1 | | 3/16/2017 | | **$3.25** | $0.00 | ☑ | ☑ |
| v 294-1 | | 1 | | 3/2/2017 | | **$1.50** | $0.00 | ☑ | ☐ |
| v 294-2 | | 1 | | 3/2/2017 | | **$2.75** | $0.00 | ☐ | ☑ |
| v 294-3 | | 1 | | 3/2/2017 | | **$10.00** | $0.00 | ☑ | ☑ |
| v 276-1 | | 1 | | 2/15/2017 | | **$3.25** | $0.00 | ☐ | ☐ |
| v 211-1 | | 4 | | 2/1/2017 | | **$25.70** | $0.00 | ☐ | ☐ |
| v 210-1 | | 1 | | 2/1/2017 | | **$10.00** | $0.00 | ☐ | ☐ |
| v 207-1 | | 4 | | 2/1/2017 | | **$25.70** | $0.00 | ☐ | ☐ |

| Details | Discount |
|---|---|
| Sub Total | $35.95 |
| Credits | $0.00 |
| Store Credit | |
| Balance | $00.00 |
| **Amount Due** | $35.95 |
| **Paid Amount** | |
| Change | $0.00 |
| Change as Store Credit | ☐ |

| | | |
|---|---|---|
| Credit Manual | **Cash** | |
| Credit Card (PPEC) | Credit Card MXM | |

| | | | | |
|---|---|---|---|---|
| **$35.95** | **$35.00** | **$40.00** | **$50.00** | **$100.00** |

Conform No Receipt

Print Receipt

Search  TimeCard  Invoice  Rack  Pick  Menu

FIG. 13

ELECTRONIC AND DIGITAL ASSEMBLY SYSTEM FOR DRY CLEANING

FIELD OF INVENTION

This invention relates to rail and hanger systems of the type used in dry cleaning and similar establishments. In greater particularity the present invention relates to improvements to the communications capabilities of such systems in context of communication of item location to the human attendant.

BACKGROUND

Rail systems are well known for use in storing or conveying products such as garments in the manufacturing, retail and dry-cleaning industries. Conventional systems typically are of a monorail-type design, in which a single track or rail is formed into a closed loop by joining sections of V-shaped steel angle iron or cylindrical bars suspended from the ceiling. A number of wheeled trolleys used to convey garments suspended on hangers are movable along the upper surface of the rail. In use, the trolleys are mounted to the rail so that the trolley body is suspended directly beneath the rail, with the wheels engaging and movable along the upper rail surface. In some installations, the rails do not include trolleys, merely serve to support hangers on which garments are hung after cleaning. An example of this type prior art is shown in FIGS. 1 and 1A.

As seen in FIG. 1, the traditional assembly tool for dry cleaning operations is the hanger A with a closed loop B on which garments on clothes hangers are placed to assemble the order for delivery to the customer as shown in FIG. 1A. Traditionally, these hangers have been integral to the manual task of determining the location where processed clothing should be placed on the rail 14 or deciding which garments are grouped together or even locating the garments for delivery to the customer.

Traditionally, dry cleaning establishments have a customer service area in which the customer drops of the clothes to be cleaned and receives a claim ticket to retrieve the clothes after they have been cleaned. Garments are tagged with an inconspicuous permanent or semi-permanent scanable label to be used during processing. The garments are then taken to a common processing plant where they are cleaned, then folded or placed on an individual delivery hanger. At this stage of the operation, multiple customers' garments are intermingled, therefore the garments must be separated and matched with other garments left by the customer to complete the listing of garments on the customers ticket for delivery back to the customer. In some assembly installations, the worker scans the garment and an automated conveyor moves the conveyor carrying a plurality of hangers to a specific location for a particular hanger to be loaded with the individual garments on their individual delivery hangers. In others they have to manually match the garments to the location.

Many of these tasks are dependent upon the operator of the system being able to visually read the information contained on a printed form and attached to the hanger with the clip C shown in FIG. 1 and correlating that information with tags 16, such as those shown in FIG. 2, applied to the garments to control the flow of the garments through the system. That is to say, the employee has to search the rail and the multitude of tags and forms to determine where a particular garment should be placed for assembly. As a result, the level of skill and training for dry cleaning attendants is unnecessarily high and turn-over for failure to properly supervise the flow of garments is high.

Once the garments are assembled and a protective plastic bag is placed over them, the invoice corresponding to the claim ticket is attached to the bag and the complete hanger A can be moved to the racking station and placed in a specific location on the racking rail for retrieval when the customer returns.

It will be appreciated that there are some analogies between the dry cleaning process and other merchant delivery systems such as may be used in restaurants and the like.

SUMMARY OF THE INVENTION

It is an object of the present electronic notification system for order assembly to help make separation of the garments from the co-mingled processed garments and assembly in accordance with the customer ticket easier, more efficient and eliminate errors. These objects are accomplished through either visual and/or audio cues. The system utilizes a digital program to generate and propagate a signal through the notification system, which is mounted on any number of assembly, racking or sorting systems or conveyors. The signal takes the form of an illuminated light, a sound, or combination thereof identifying the specific location designated for action by the attendant and related to a specific customer. The notification system may also indicate by digital display the number of pieces on a specific order, customer information or other ticket detail. The notification system will also display a uniquely lighted color or pattern and/or on the digital display to identify order status, such as when the order is incomplete, in process, or completed.

BRIEF DESCRIPTION OF THE DRAWINGS

Referring to the drawings which are appended hereto and which form a portion of this disclosure, it may be seen that:

FIGS. 10 to 13 show control screens typically used with the various embodiments;

DETAILED DESCRIPTION

Figure 1:
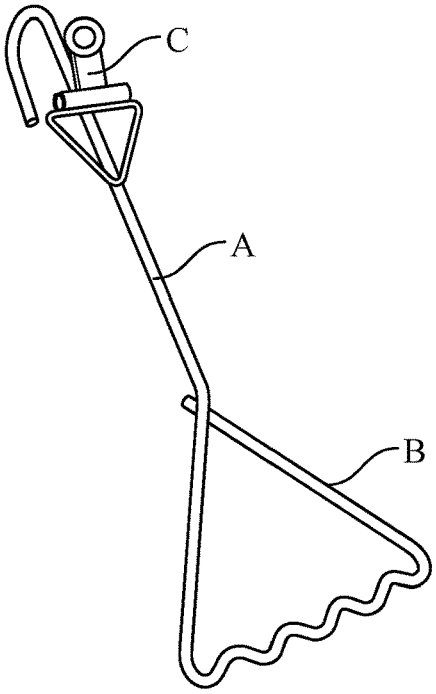
FIG. 1 (Prior Art)
FIG. 1 shows a prior art hanger which is in common use in dry cleaning conveyors.
Figure 1A:
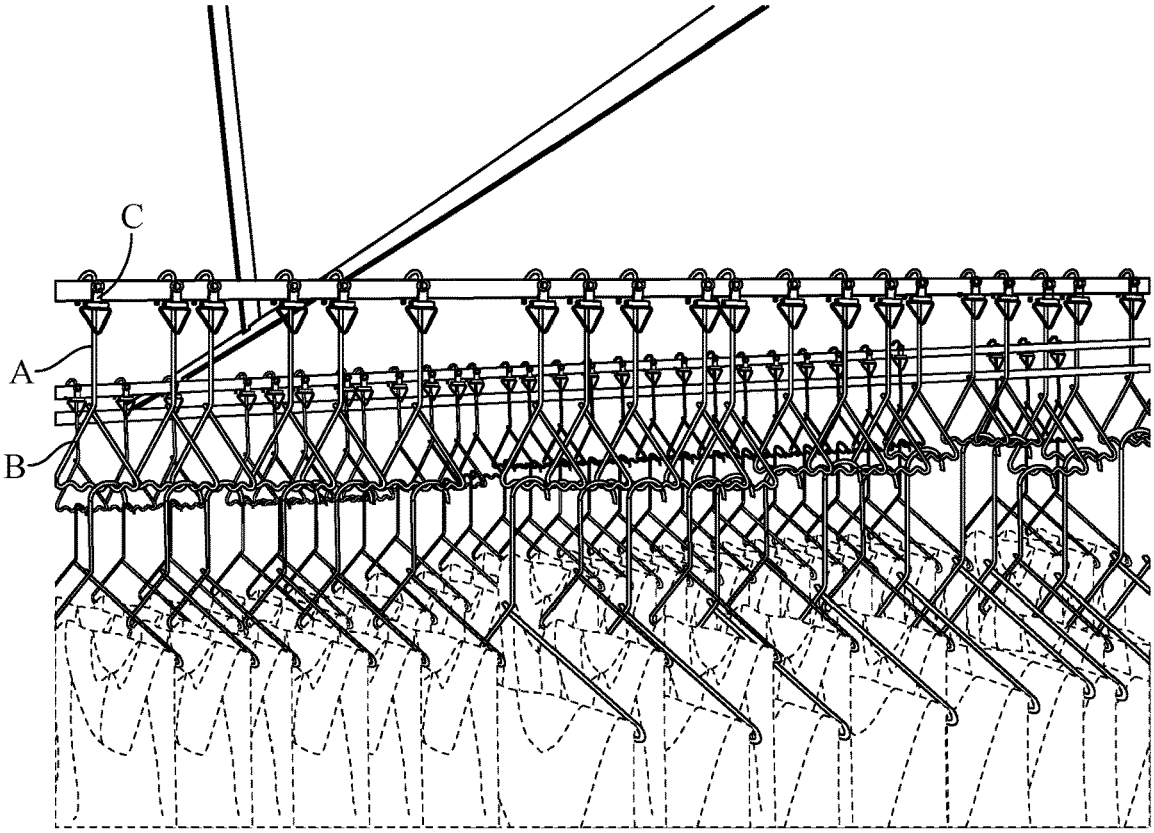
FIG. 1A (Prior Art)
FIG. 1A shows a prior art rail system.
Figure 2:
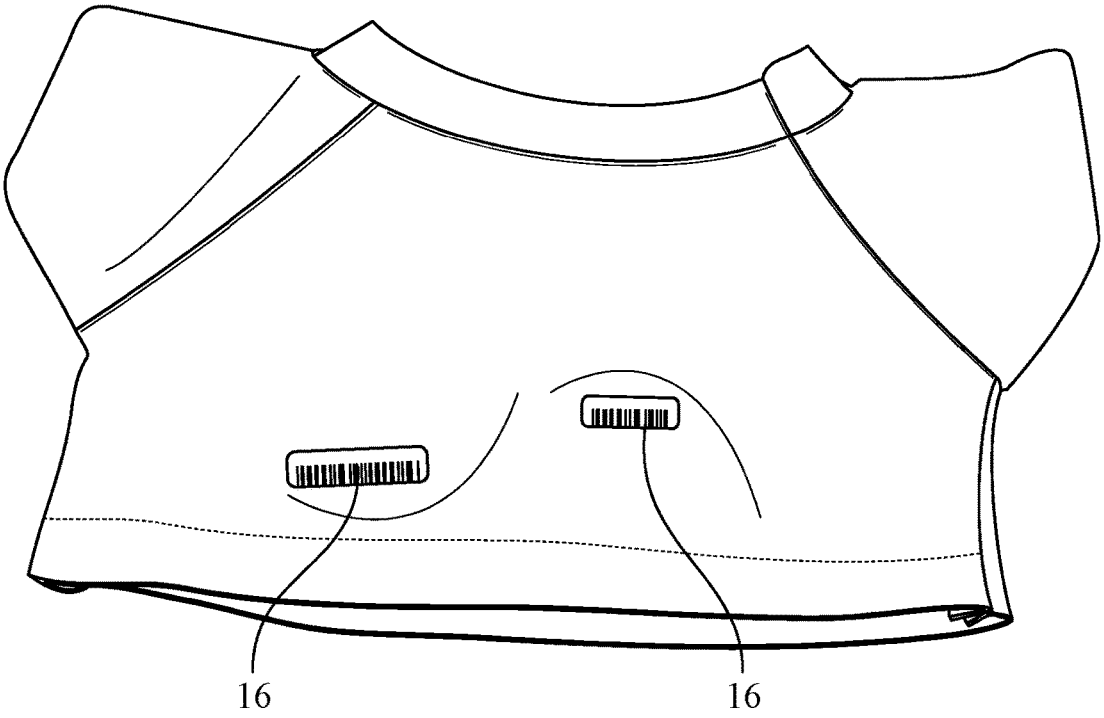
FIG. 2, shows the information tags typically used in dry cleaning on a garment.

One or more of the above objects can be achieved, at least in part, by providing a combination of communication software and signaling hardware linked to the communication software. Referring to FIGS. 3, 4A and 4B, and 5, a first embodiment 10 of the invention is discussed. In this embodiment 10 each prior art assembly hanger is replaced by a smart assembly hanger 11 which is physically designed to support the processed garments in the same manner as the prior art hanger on a loop 12, however, a controllable led light puck 13 is affixed at the apex of each loop 12. Each light puck 13 is addressable in such a manner as to illuminate in a selected color and in a selected mode such as flashing or steady state as is well known in the art. In the embodiment shown in FIG. 3 the assembly hangers are hard wired to each other by a cable connection 14 with USB terminal connections, as indicated in FIG. 5, for connecting to a computer running a software program to selectively illuminate each light puck 13. It should be understood that any hardwired connection may be used including shielded Cat 5 and other known wiring methods.

Figure 6:
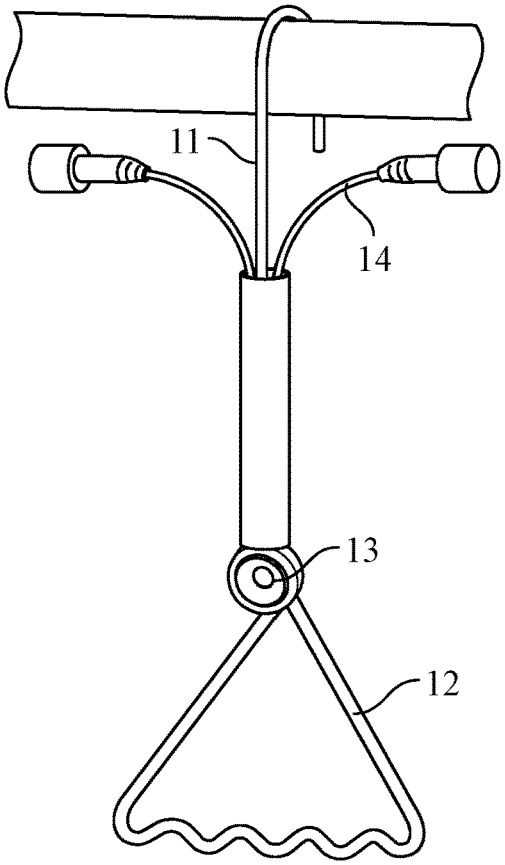
FIG. 6 shows a standard hanger modified with the visual notification assembly.

In another embodiment, the traditional hanger may be retrofitted as shown in FIG. 6 with an addressable light puck 13 and a cable connector 14, thus the system may retain the original hanging structure in combination with the new visual notification system.

Figure 4A:
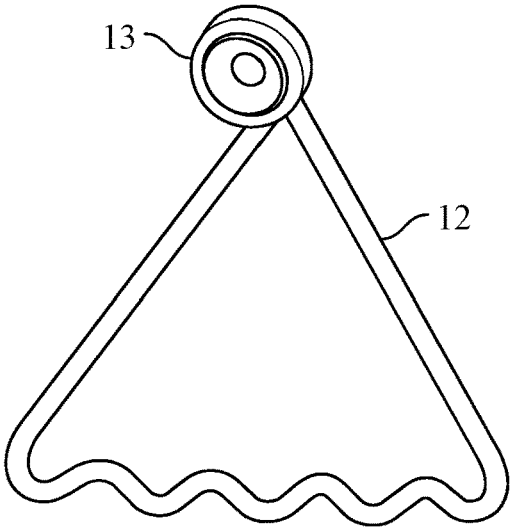
FIGS. 4A and 4B show the hanger and light puck of the system.
Figure 4B:
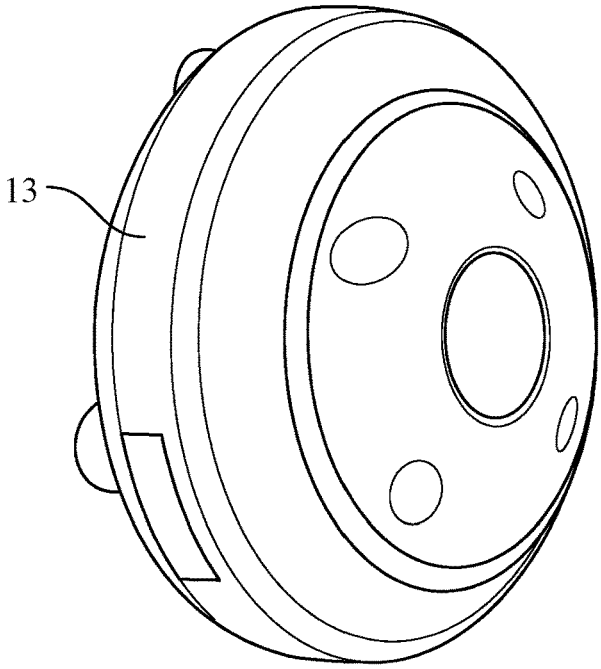
Figure 5:
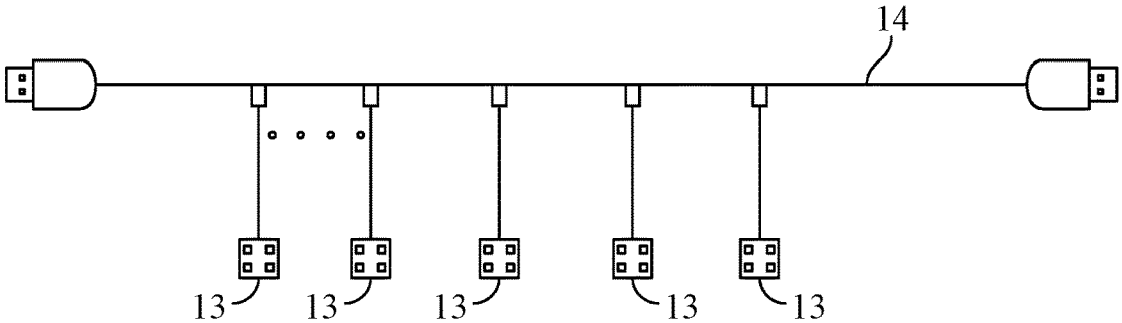
FIG. 5 shows a partial wiring diagram for USB connection to an existing system.

In another embodiment, the led light puck 13 shown in FIG. 4B may be affixed to a standard hanger such as shown in FIG. 1 with a nested receiver to allow control of the light puck over WiFi, Z-Wave, Zigbee, RF or other networks. Thus, the essence of the hardware is that each hanger has associated with it an addressable light puck which can be communicated with over a known electronic network.

Figure 8:
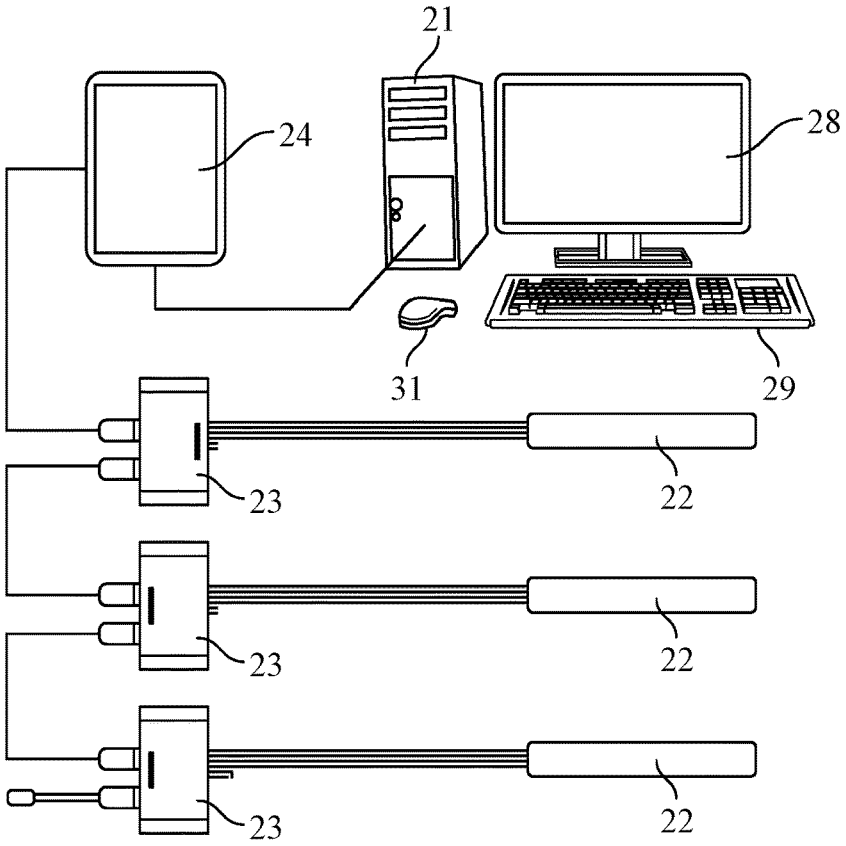
FIG. 8 is a diagrammatic view of a first embodiment.
Figure 9:
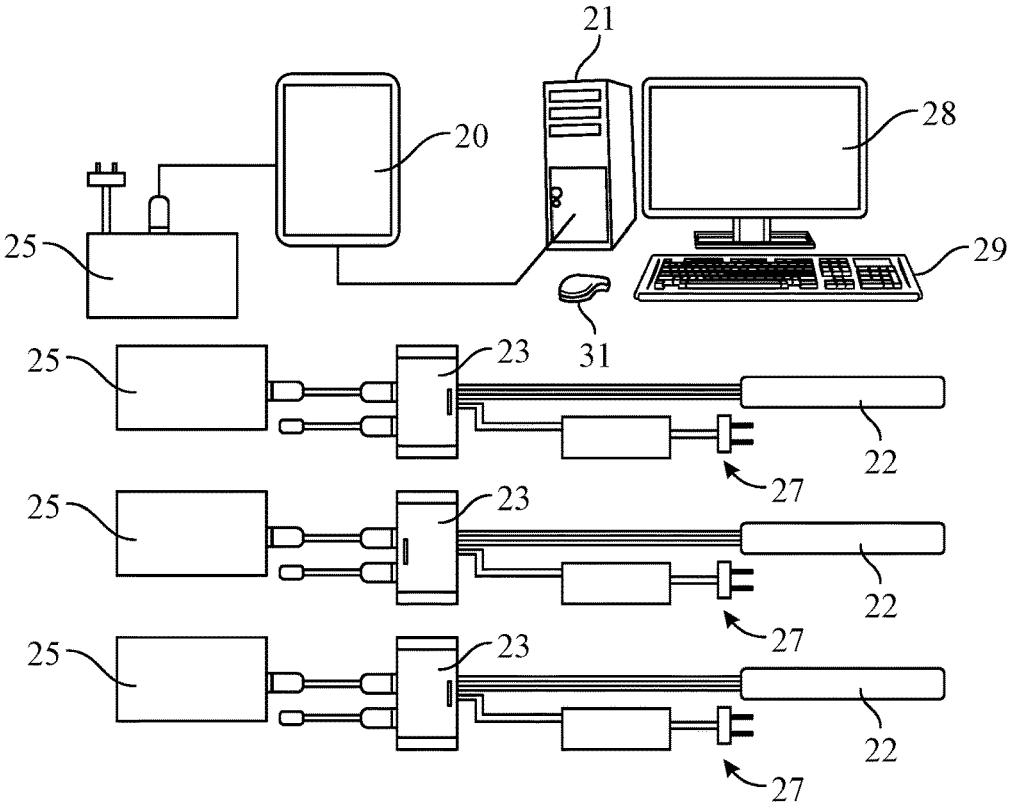
FIG. 9 is a diagrammatic view of a wireless embodiment.

Referring to FIGS. 8 and 9, a software component will run on a hardware controller or computer 21 and provide for communications between new or existing third-party software systems used in the management of customer information or in the control of the existing conveyor systems and the visual notification system 10. The software provides translation of requests from the existing third-party systems and activates the notification system as designated by the requesting entity. The software component running on the hardware controller will be able to communicate over wired, as shown in FIG. 8, or wireless, as shown in FIG. 9, network with the third-party systems and various protocols such as over WiFi, Z-Wave, Zigbee, RF or other protocol to communicate with the visual notification system. In one embodiment the addressable LED's can be driven on a digital multiplexing (DMX) circuit 20. As indicated in FIGS. 8 and 9 each addressable LED light puck 13 includes the diode 22 as well as a DMX decoder 23. Each DMX receiver is electronically linked to a DMX RGB controller 24 which may be integrated into the system computer 21 or connected externally of the computer 21. The software controlled DMX RGB controller allows the user to control both the color and illumination of the individual light pucks 13 as will be discussed hereafter. As will be understood, the wireless embodiment also includes receiver/transmitter components 25 which facilitate communication between the DMX RGB controller and the DMX decoder. Likewise, the wireless embodiment must include discrete power supplies 27 for each lighting puck 13, whereas the hardwired system can use a single power supply. It should further be understood, that the system can cause the light puck to emit any selected color or to flash in any sequence or any combination of color and sequence. Further, it is within the contemplation of the invention that an audible signal can also be generated for each light puck.

This technology may be used in all type of pre-existing and new conveyor systems to assist with completing an order, searching inventory, identifying customers or assist with the differentiation between type of items and products. This technology could also be applicable to other industry segments to provide either audio or visual cues to assist operators in product identification. In the dry cleaning industry, it can be used to support the assembly of garments through the visual indication or tagging of customer garments on the conveyor.

Referring to FIGS. 10 to 13, these figures depict typical computer screens used by an employee to interface with the system. The screens will appear on the system monitor 28 shown in FIG. 8 or 9 and may be touch screen type screens such that the user does not need additional equipment or the user may use a keyboard 29 and mouse 31 to input commands.

Figure 10:
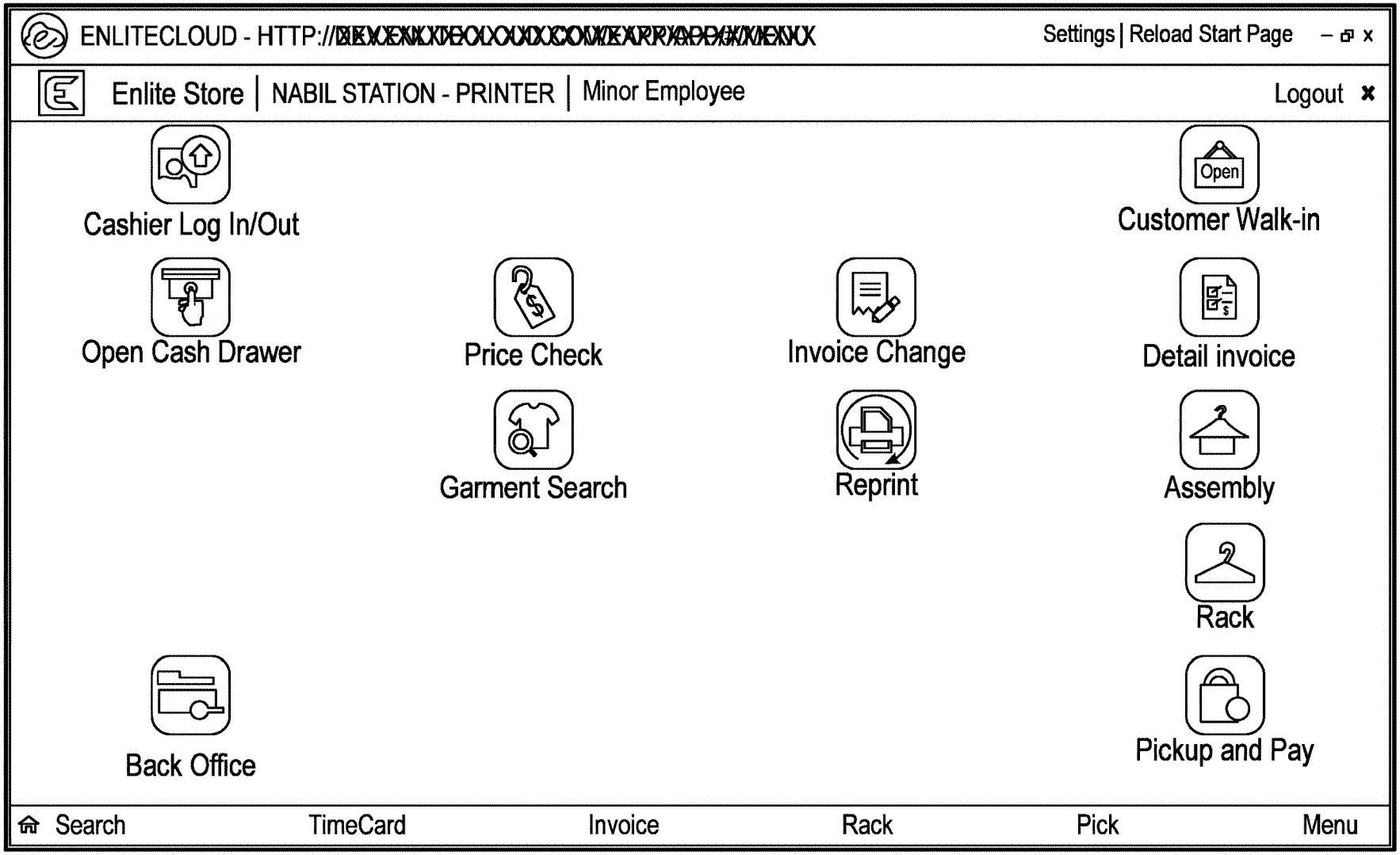

FIG. 10 shows a typical Application Home Screen

This screen is the application main screen and principal point of entry for all employees. This screen represents the default interface for accessing all "Front Office" functions of the application, including Cashier Functions, Register Functions, Customer Functions and Ticket/Invoice Functions.

Figure 11:
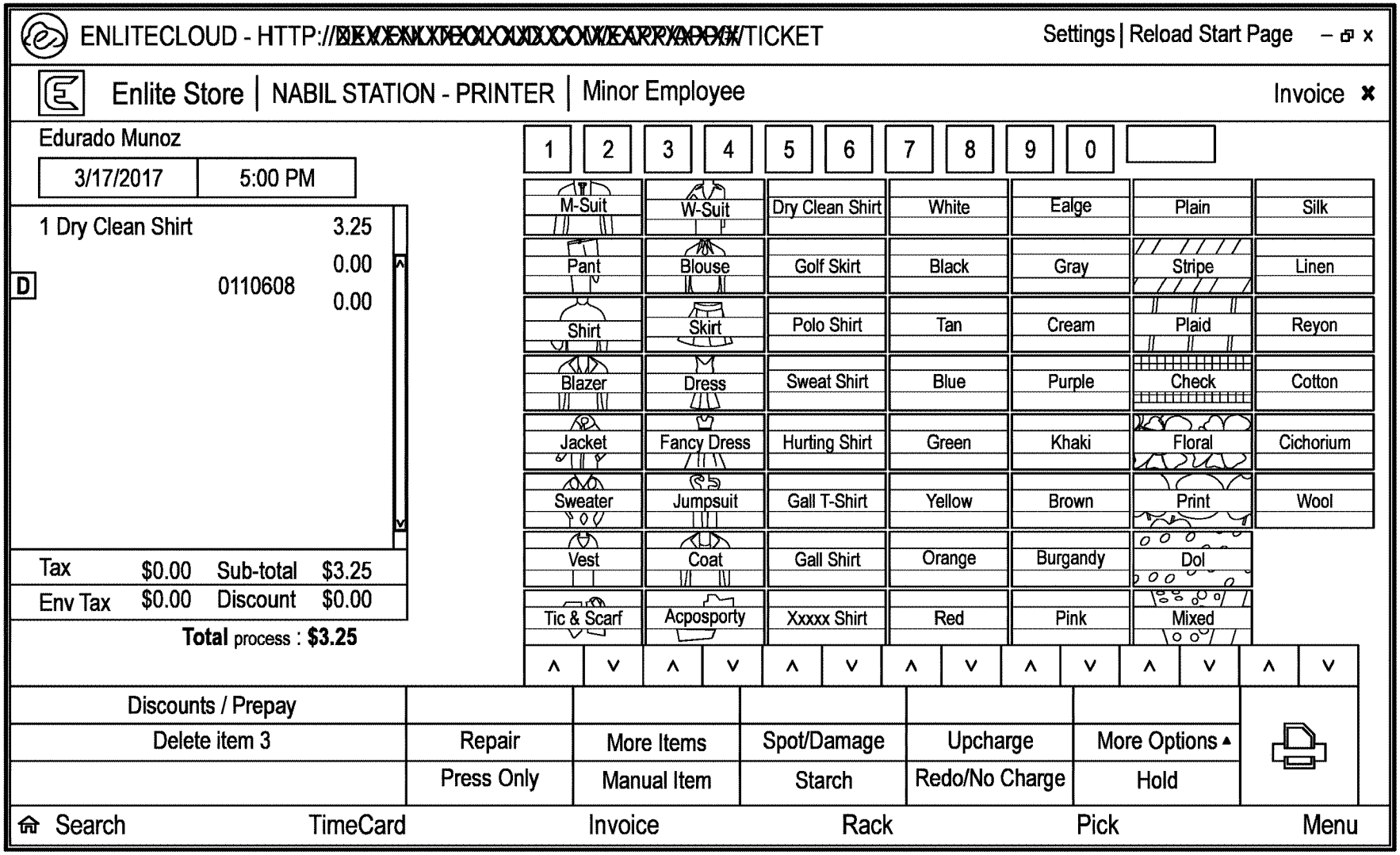

FIG. 11 shows a typical Ticket/Invoice Detail Screen

Figure 3:
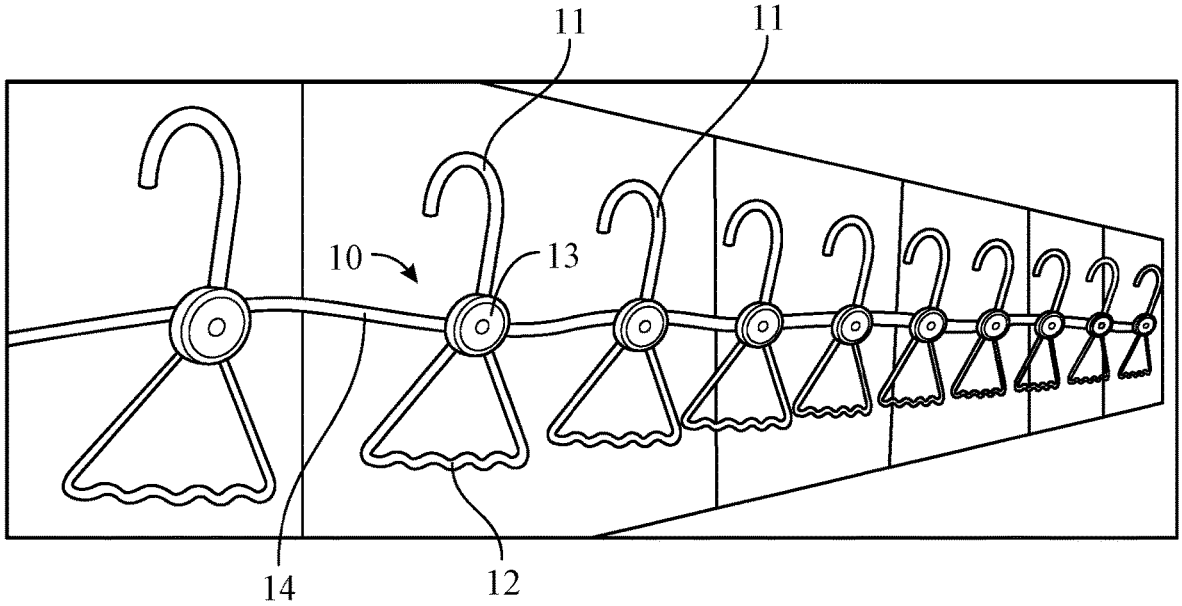
FIG. 3, shows a first embodiment of my system.
Figure 7:
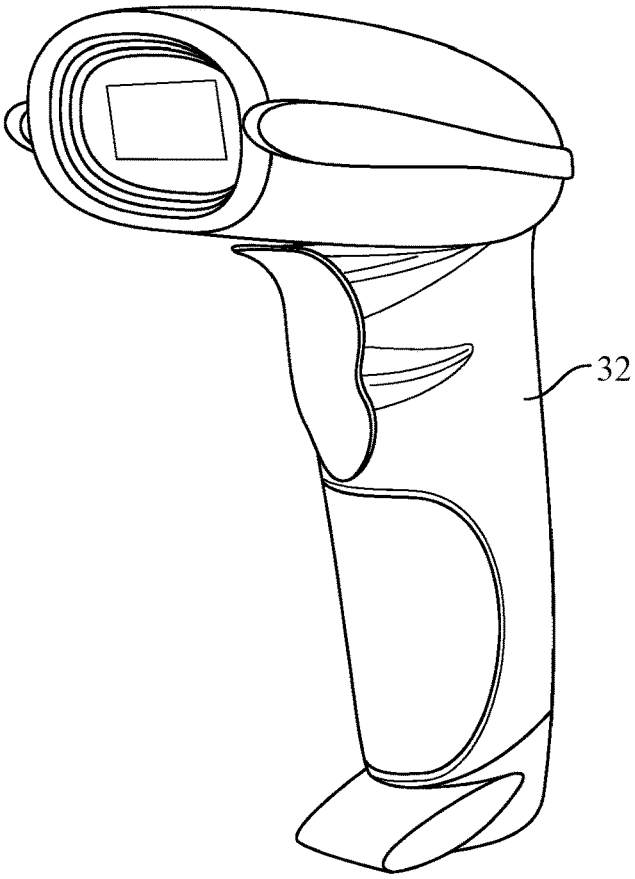
FIG. 7 depicts a wireless scanner.

This screen shows the main interface where a new customer order is created or an existing order is modified. It contains all menu items displayed in a graphical interface with a picture menu for matching the customers garments to the ticket, textual description of the processing or garment order, and color coding to again match to the individual garments in the order to provide ease of use and easy identification of items to add to the customer ticket representing the customer's order. That is to say, when a new order is to be entered, this screen allows the user to easily select the items to be included in the order by matching the garments to the screen and adding them to the ticket. The individual order items, including description, notes, modifiers, special instructions and price are included in the ticket build-up on the left hand-side. The customer's order total, or ticket total, is also displayed on the left under the ticket build-up. All activity relating to the customer's order and ticket can be managed on this screen. Garments that have not been previously tagged are tagged with tags such as seen in FIG. 3 for use by the system. The tags are scanable with a wireless barcode type scanner 32 as shown in FIG. 7. Through-out the system the garment may be scanned at selected system locations with the scan serving as an input to the computer to indicate the garment's progress through the dry cleaning stages.

Figure 12:
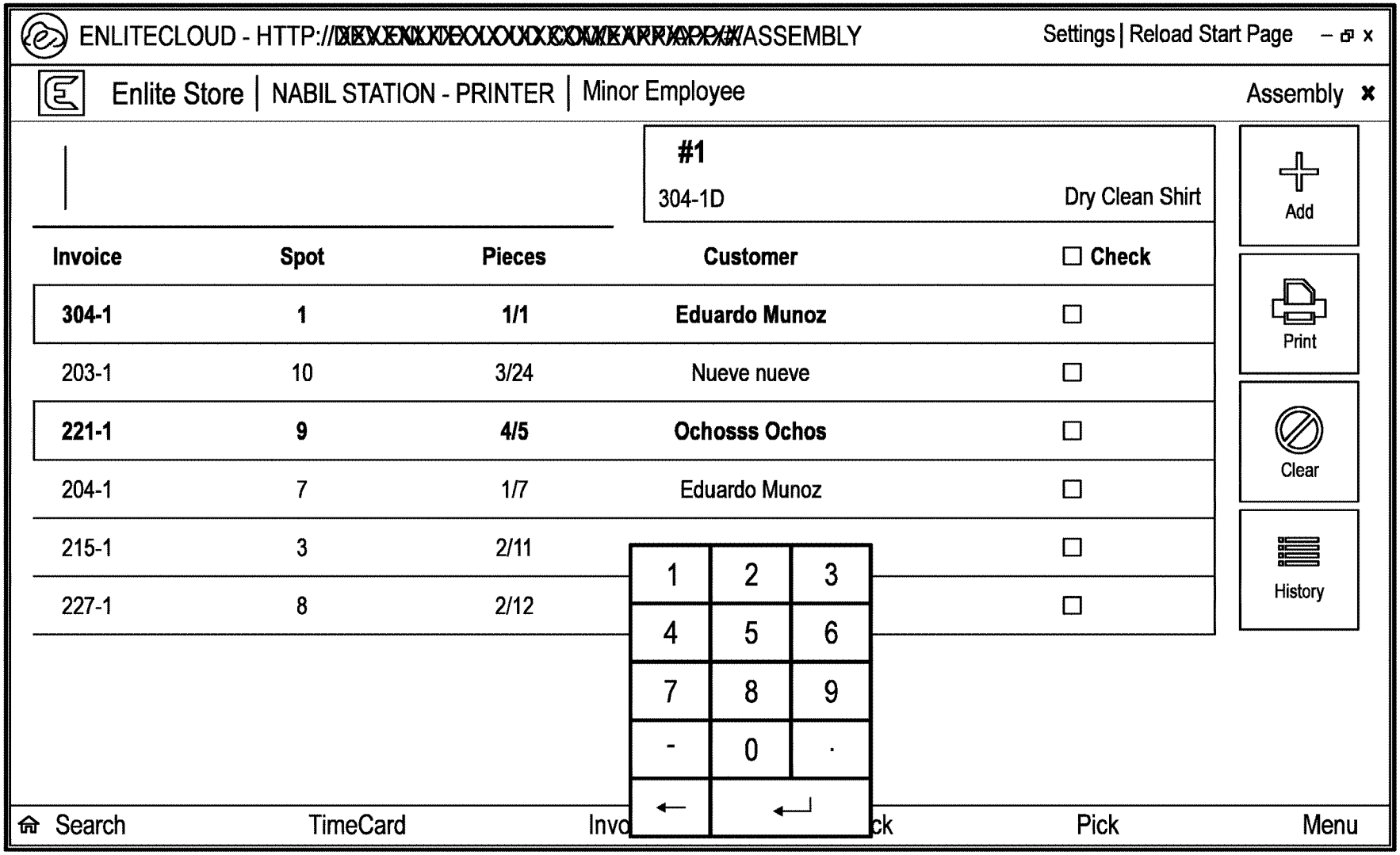

FIG. 12 shows a typical Assembly Screen

When garments have been processed and are ready to be sorted to reassemble them to correspond to the customer's ticket, this screen facilitates the assembling of garments/items against a ticket/invoice. When an employee initially opens this screen, assuming the assembly has not been used before, the employee will be prompted with a blank screen with no records displayed in the main display area. As the employee selects garments and scans or enters the garment barcode id in the top-left search field, a position number, which has been assigned by the computer to correspond to the physical location on the rack where the order is to be assembled, will be displayed in the top right. The invoice number, for example 304-1, and the garment details for the item being scanned will appear in the same notification area. The ticket/invoice will also be added to the assembly status in the main display area. As the employee continues to scan and place garments in rack positions (representing individual invoice numbers), the number of pieces assembled are incremented until all garments on a given ticket/invoice have been collected. Once all pieces have been collected, the status of the invoice row on the display screen and hanger 11 changes color.

The Assembly Screen is also tied to the LED Assisted Rapid Assembly system. Each hanger 11 and light puck 13 are assigned to a specific position on the rack in the set up of the system. Whenever a garment id is scanned and the rack/slot number is displayed on the screen, the corresponding light puck will flash for a pre-determined period, such as 15 seconds, indicating to the employee the hanger on which that specific garment should be placed. When the predetermined period expires, the light puck is turned off. If the employee fails to place the garment, for example due to some interruption, he can rescan the garment id tag and the puck will again flash. As he continues to scan garments, his movement along the rack is directed by the illuminated light puck corresponding to the location for the scanned garment. When all garments on a given ticket/invoice have been collected on the hanger, the color of the LED in the puck 13 will also change, identifying that the order is complete and ready to be moved to the next stage, i.e. to the customer delivery rack. Other variations are also possible. For example, the light puck may be caused to flash to indicate that additional garments are required at this location, or a query may cause the light puck to flash to indicate which positions are completely filled and which are lacking necessary garments. Further, it should be understood that the same principles may be applied to the racking station such that when an order is completed, the location on the racking station to which the completed order is to be moved can be indicated by a flashing LED on the racking station. Of course, when the customer returns, the order may be quickly located by scanning the customer's claim check which will signal the system to cause the LED on the rack to illuminate.

FIG. 13 depicts the Ticket/Invoice Pick-n-Pay Screen

On this screen the tickets/invoices are marked as delivered and/or paid. If a ticket/invoice is marked picked/delivered, then it is assumed that the employee has delivered the garments/goods associated with that invoice to the customer. If a ticket/invoice is marked paid, then the employee will have collected payment for that ticket/invoice from the customer. The employee has the option to select how the customer will pay, selecting Cash, Credit Card, Check, etc. and then processing the payment transaction as required. Once a ticket/invoice has been marked picked and paid, then the ticket/invoice will no longer be displayed on this screen as it is assumed that the goods have been delivered and the customer has paid.

The present invention may likewise be applied to a restaurant setting. In such a situation, a server may enter the order for a table or group of tables on a handheld input device or a computer screen. Each item on the menu can be identified by a code and the entry of the item code with the order number will enable the menu item to be tracked, such that when the kitchen receives the order it prepares the menu item and then presents it for pick up by the server. As the item is presented to a pick up location or window, the server can determine which table order the menu item belongs to and move the item to a holding area, whether the table order is complete and ready to be served to the table. Alternatively the pickup window may have a number of separate holding stations, each having an addressable led associated with it. The items may be tracked using bar coded serving dishes or concurrently presented tags available to the kitchen to place on each serving dish with the food item.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What we claim is:

1. A product control system for dry cleaners and the like comprising:

a. a plurality of hangers for supporting processed clothing, each hanger of said plurality of hangers including an indicator providing a human sensible output related to the status of a customer's dry cleaning order;

b. a customer specific tag to be applied to each item of clothing presented by a customer;

c. a control unit including an operator interface and an output to each of said plurality of hangers, said interface including an input device allowing an operator to identify a customer and clothing associated with said customer; and d. a scanning device capable of reading each customer specific tag and providing an input to said control unit indicating that said customer specific tag had been scanned;

wherein said indicator providing a human sensible output is responsive to said control unit to indicate the location for placement of an item of clothing in accordance with the customer specific tag read by said scanning device.

2. A product control system for order completion comprising:

a. a plurality of deliver holders for supporting processed items, each delivery holder of said plurality of holders including an indicator providing a human sensible output related to the status of a customer's order;

b. a customer specific tag to be applied to each item of the order presented by a customer;

c. a control unit including an operator interface and an output to each of said plurality of holders, said interface including an input device allowing an operator to identify a customer and item associated with said customer; and d. a scanning device capable of reading each customer specific tag and providing an input to said control unit indicating that said customer specific tag had been scanned;

wherein said indicator providing a human sensible output is responsive to said control unit to indicate the location for placement of an item in accordance with the customer specific tag read by said scanning device.

3. A method for sorting and assembling garments in a garment processing facility comprising:

a. Placing a garment specific, customer specific identification tag on each garment;

b. Entering each garment identification into a computer control system for monitoring the progress of each garment, wherein each garment forms a portion of an order identifiable with a specific customer, wherein each garment is identified to said computer control system by using an electronic scanner to read said tag as an input to said computer control system;

c. Retrieving a garment and using said tag to identify the garment to the computer control system;

d. Activating a human sensible indicator at an assembly location for garments belonging to a particular order such that a human operator may move the retrieved garment to the assembly location; and e. Repeating steps c and d until all garments in the particular order have been assembled.

4. The method as defined in claim 3 wherein said assembly location is a hanger on an assembly rack.

5. The method as defined in claim 4 wherein said human sensible indicator is activated for a preset period of time to allow said operator to move the garment to the assembly location.

6. The method as defined in claim 5 wherein said computer control system includes a graphic user interface displaying the status of selected open orders and garments being retrieved, wherein said graphic user interface displays the assembly location and the garments retrieved to said assembly location.

7. The method as defined in claim 4 further comprising moving the completed order from the assembly location to a customer delivery location.

8. A method for sorting and assembling items prepared for delivery to a customer comprising:

a. Associating an item specific, customer specific identification tag on each item to be prepared;

b. Entering each item identification into a computer control system for monitoring the progress of each item, wherein each item forms a portion of an order identifiable with a specific customer, wherein each item is identified to said computer control system by using an electronic scanner to read said tag as an input to said computer control system;

c. Retrieving an item and using said tag to identify the item to the computer control system;

d. Activating a human sensible indicator at an assembly location for items belonging to a particular order such that a human operator may move the retrieved item to the assembly location; and e. Repeating steps c and d until all items in the particular order have been assembled.

9. The method as defined in claim 8 wherein said assembly location is a hanger on an assembly rack.

10. The method as defined in claim 9 wherein said human sensible indicator is activated for a preset period of time to allow said operator to move the item to the assembly location.

11. The method as defined in claim 10 wherein said computer control system includes a graphic user interface displaying the status of selected open orders and items being retrieved, wherein said graphic user interface displays the assembly location and the items retrieved to said assembly location.

12. The method as defined in claim 8 further comprising moving the completed order from the assembly location to a customer delivery location.

* * * * *